US006216427B1

(12) United States Patent
Cupp

(10) Patent No.: US 6,216,427 B1
(45) Date of Patent: Apr. 17, 2001

(54) CORRECTLY SEATED STIRRUP

(76) Inventor: David Paul Cupp, 1976 Calle Media, Casa Grande, AZ (US) 85222

( * ) Notice: Subject to any disclaimer, the term of this patent is extended or adjusted under 35 U.S.C. 154(b) by 0 days.

(21) Appl. No.: 09/435,893

(22) Filed: Nov. 8, 1999

(51) Int. Cl.[7] ..... B68C 3/00
(52) U.S. Cl. ..... 54/47; D30/142
(58) Field of Search ..... 54/47, 48; D30/142

(56) References Cited

U.S. PATENT DOCUMENTS

| | | | | |
|---|---|---|---|---|
| 169,209 | * | 10/1875 | Wagstaff | 54/47 |
| 374,992 | * | 12/1887 | Nixon | 54/48 |
| 2,532,082 | * | 11/1950 | Borst | 54/47 |
| 3,905,179 | * | 9/1975 | Bischeltsrieder | 54/47 |

* cited by examiner

*Primary Examiner*—Robert P. Swiatek

(57) ABSTRACT

A correctly seated stirrup including a lower portion having a foot hole with a central axis there through and formed with a top wall, a bottom wall, and spaced side walls there between. Each side wall is trapezoidal in shape and has a shorter width adjacent to the top wall and a greater width adjacent to the bottom wall. The side walls are located closer together adjacent to the top wall than adjacent to the bottom wall whereby the foot hole is formed in a trapezoidal configuration. An upper portion has a strap hole with an axis there through perpendicular to the axis of the foot hole. The upper portion is formed with a top wall, a bottom wall, and spaced side walls there between, whereby the strap hole is formed with a width greater than the width of the top and bottom walls of the lower portion. An intermediate coupling portion between the lower portion and the upper portion forms a one piece homogeneous stirrup.

5 Claims, 2 Drawing Sheets

FIG 1
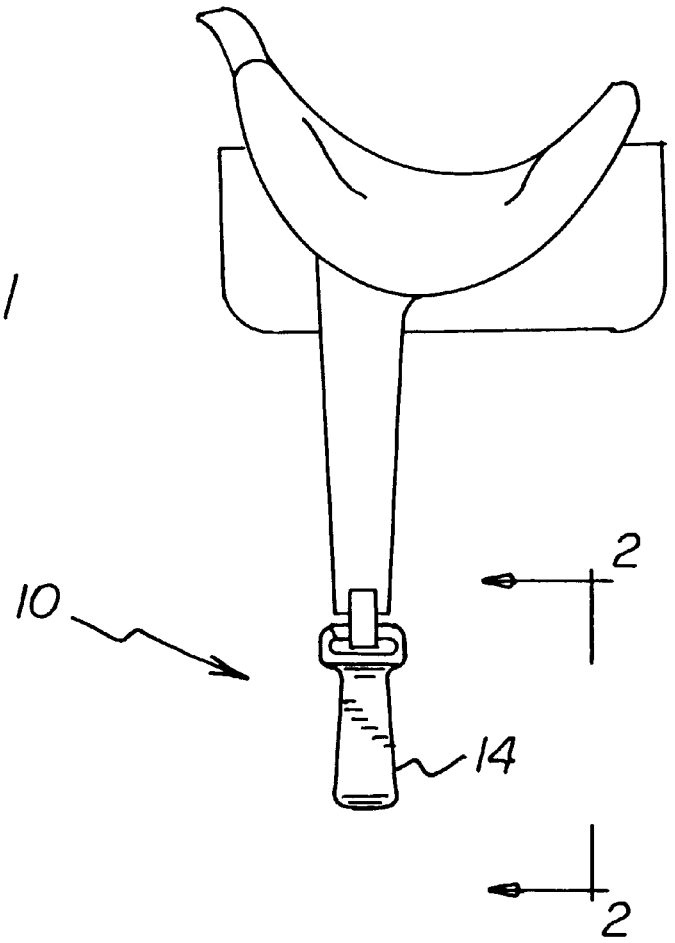
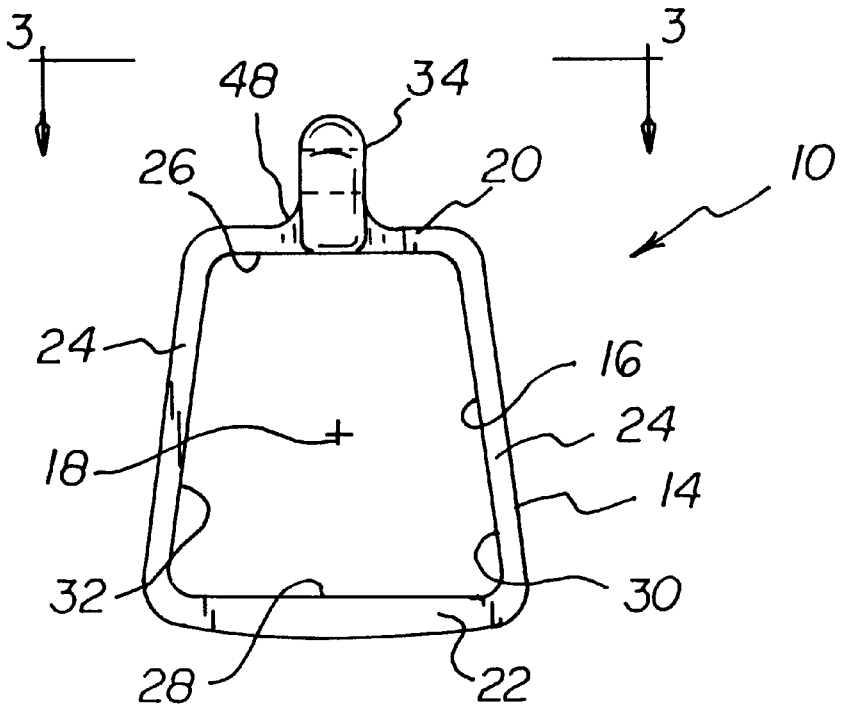
FIG 2

FIG 3
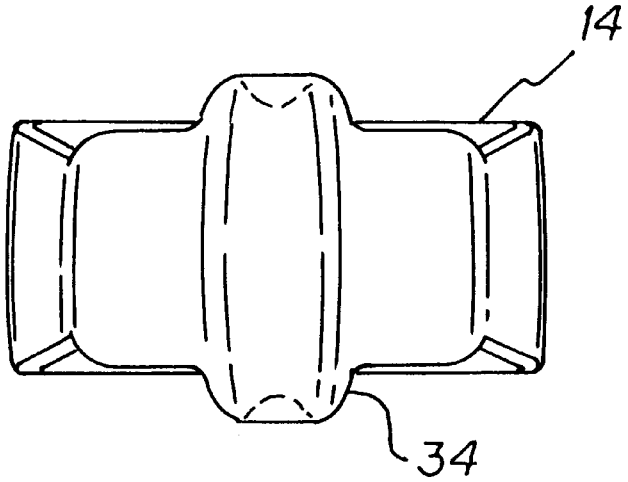
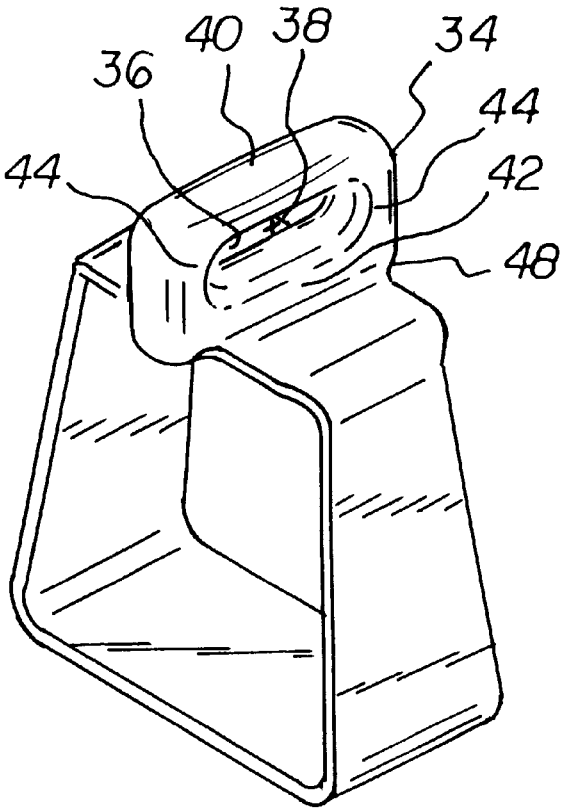
FIG 4

CORRECTLY SEATED STIRRUP

BACKGROUND OF THE INVENTION

1. Field of the Invention

The present invention relates to a correctly seated stirrup and more particularly pertains to increasing the safety, comfort and aesthetics of stirrups.

2. Description of the Prior Art

The use of stirrups of known designs and configurations is known in the prior art. More specifically, stirrups of known designs and configurations heretofore devised and utilized for the purpose of improving stirrups through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,172,538 to Luger discloses a stirrup pad. U.S. Pat. No. 509,139 to Riker and Green discloses a stirrup. Lastly, U.S. Pat. No. 608,605 to House discloses a stirrup.

While these devices fulfill their respective, particular objectives and requirements, the aforementioned patents do not describe a correctly seated stirrup that allows increasing the safety, comfort and aesthetics of stirrups.

In this respect, the correctly seated stirrup according to the present invention substantially departs from the conventional concepts and designs of the prior art, and in doing so provides an apparatus primarily developed for the purpose of increasing the safety, comfort and aesthetics of stirrups.

Therefore, it can be appreciated that there exists a continuing need for a new and improved correctly seated stirrup which can be used for increasing the safety, comfort and aesthetics of stirrups. In this regard, the present invention substantially fulfills this need.

SUMMARY OF THE INVENTION

In view of the foregoing disadvantages inherent in the known types of stirrups of known designs and configurations now present in the prior art, the present invention provides an improved correctly seated stirrup. As such, the general purpose of the present invention, which will be described subsequently in greater detail, is to provide a new and improved correctly seated stirrup and method which has all the advantages of the prior art and none of the disadvantages.

To attain this, the present invention essentially comprises a correctly seated stirrup is comprised of a plurality of components. Such components in their broadest context include a lower portion, an upper portion, and an intermediate coupling portion. Such components are individually configured and correlated with respect to each other so as to attain the desired objective. First provided is a lower portion. The lower portion has a foot hole. A central axis is provided through the foot hole. The lower portion is formed with an essentially horizontal top wall and an essentially horizontal bottom wall. Spaced side walls are provided between the top and bottom walls. Each side wall is trapezoidal in shape. Each side wall has a shorter width adjacent to the top wall and a greater width adjacent to the bottom wall. The lower portion has an essentially common thickness throughout at least a majority of its extent. The side walls are located closer together adjacent to the top wall than adjacent to the bottom wall. Thus, the foot hole is formed of four facing planar surfaces in a trapezoidal configuration. An upper portion is next provided. The upper portion has a strap hole. The strap hole has an axis perpendicular to the axis of the foot hole. The upper portion is formed with an essentially horizontal top wall and an essentially horizontal bottom wall. Spaced arcuate side walls are provided between the top and bottom walls. Thus, the strap hole is formed in an oval shaped configuration with a width greater than the width of the top and bottom walls of the lower portion. Lastly, provided is an intermediate coupling portion. The intermediate coupling portion is located between the lower portion and the upper portion. In this manner a one piece homogeneous stirrup is formed. The stirrup may be molded from an elastomeric material selected from the class of elastomers including polyurethane, polyethylene, and rubber, natural or synthetic or blends thereof. The height of the lower portion of the stirrup is about three times the height of the upper portion. The lower surface of the upper wall of the lower portion is flat and planarly coextensive with the lower surface of the upper portion.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved correctly seated stirrup which has all of the advantages of the prior art stirrups of known designs and configurations and none of the disadvantages.

It is another object of the present invention to provide a new and improved correctly seated stirrup which may be easily and efficiently manufactured and marketed.

It is further object of the present invention to provide a new and improved correctly seated stirrup which is of durable and reliable constructions.

An even further object of the present invention is to provide a new and improved correctly seated stirrup which is susceptible of a low cost of manufacture with regard to both materials and labor, and which accordingly is then susceptible of low prices of sale to the consuming public, thereby making such correctly seated stirrup economically available to the buying public.

Even still another object of the present invention is to provide a correctly seated stirrup for increasing the safety, comfort and aesthetics of stirrups.

Lastly, it is an object of the present invention to provide a new and improved correctly seated stirrup including a lower portion having a foot hole with a central axis there through and formed with a top wall, a bottom wall, and spaced side walls there between. Each side wall is trapezoidal in shape and has a shorter width adjacent to the top wall and a greater width adjacent to the bottom wall. The side walls are located closer together adjacent to the top wall than adjacent to the bottom wall whereby the foot hole is formed in a trapezoidal configuration. An upper portion has a strap hole with an axis there through perpendicular to the axis of the foot hole. The upper portion is formed with a top wall, a bottom wall, and spaced side walls there between, whereby the strap hole is formed with a width greater than the width of the top and bottom walls of the lower portion. An intermediate coupling portion between the lower portion and the upper portion forms a one piece homogeneous stirrup.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the new and improved correctly seated stirrup constructed in accordance with the principles of the present invention.

FIG. 2 is a side elevational view taken along line 2—2 of FIG. 1.

FIG. 3 is a top view taken along line 3—3 of FIG. 2.

FIG. 4 is a perspective view of the stirrup of the prior Figures.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved correctly seated stirrup embodying the principles and concepts of the present invention and generally designated by the reference numeral 10 will be described.

The present invention, the correctly seated stirrup 10 is comprised of a plurality of components. Such components in their broadest context include a lower portion, an upper portion, and an intermediate coupling portion. Such components are individually configured and correlated with respect to each other so as to attain the desired objective.

First provided is a lower portion 14. The lower portion has a foot hole 16. A central axis 18 is provided through the foot hole. The lower portion is formed with an essentially horizontal top wall 20 and an essentially horizontal bottom wall 22. Spaced side walls 24 are provided between the top and bottom walls. Each side wall is trapezoidal in shape. Each side wall has a shorter width adjacent to the top wall and a greater width adjacent to the bottom wall. The lower portion has an essentially common thickness throughout at least a majority of its extent. The side walls are located closer together adjacent to the top wall than adjacent to the bottom wall. Thus, the foot hole is formed of four facing planar surfaces 26, 28, 30, 32 in a trapezoidal configuration.

An upper portion 34 is next provided. The upper portion has a strap hole 36. The strap hole has an axis 38 perpendicular to the axis of the foot hole. The upper portion is formed with an essentially horizontal top wall 40 and an essentially horizontal bottom wall 42. Spaced arcuate side walls 44 are provided between the top and bottom walls. Thus, the strap hole is formed in an oval shaped configuration with a width greater than the width of the top and bottom walls of the lower portion.

Lastly, provided is an intermediate coupling portion 48. The intermediate coupling portion is located between the lower portion and the upper portion. In this manner a one piece homogeneous stirrup is formed. The stirrup may be molded from an elastomeric material selected from the class of elastomers including polyurethane, polyethylene, and rubber, natural or synthetic or blends thereof or, in the alternative, of metal. The height of the lower portion of the stirrup is about three times the height of the upper portion. The lower surface 50 of the upper wall of the lower portion is flat and planarly coextensive with the lower surface of the upper portion.

Traditional stirrups hang parallel or opposite of the correctly seated position and must be manually turned out of repositioned, in order to achieve the required correctly seated position for sitting a saddle. Traditional stirrups must also be constantly held in this position, using feet and legs, while sitting a saddle. The present invention eliminates the need to manually turn out, reposition and/or hold the stirrup in the required correctly seated position.

The present invention provides a greater degree of safety to the rider when mounting and sitting the saddle. When sitting a saddle, traditional stirrups must manually be turned out or repositioned in order to achieve the required corrected seated position, to enable the rider's feet to be placed in them. Turning out or repositioning the traditional stirrup while mounting can be difficult and/or dangerous to the rider if the horse begins to move before the rider is properly seated and/or does not have both feet securely placed in the stirrups.

In the event that a rider's foot comes out of the traditional stirrup while seated, the traditional stirrup returns to the parallel or opposite of the correctly seated position. When and if this happens, while the horse is in motion, it can be dangerous to the rider. Trying to return a traditional stirrup to the correctly seated position while a horse is in motion can also be dangerous to the rider. In both cases, the rider can lose balance, become unseated, and an undesired dismount may result, thereby increasing the risk of bodily injury.

The present invention also provides a greater level of comfort than traditional stirrups. This is due to the fact that the present invention eliminates the need for the constant foot and leg pressure that the traditional stirrups require in order to maintain the correctly seated position. The present invention does not require foot or leg pressure to obtain or maintain the correctly seated position.

The present invention aesthetically enhances the saddle. Other known methods to make traditional stirrups hang in the correctly seated position often alter and/or disfigure the saddle from the way in which it is manufactured. Since the present invention hangs in the correctly seated position, no alteration is required or necessary.

Because the traditional stirrup hangs parallel to the stirrup leathers or opposite of the correctly seated position, it must be turned out in order to achieve the correctly seated position. The present invention is designed to hang in the correctly seated position at all times thereby eliminating the need to reposition it thereby reducing the risk of injury while providing a greater degree of comfort, without altering or disfiguring the saddle.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A correctly seated stirrup for increased safety, comfort and aesthetics, comprising, in combination:

a lower portion having a foot hole with a longitudinal central axis there through and formed with an essentially horizontal top wall, an essentially horizontal bottom wall, and spaced side walls therebetween, each side wall being trapezoidal in shape and having a shorter width adjacent to the top wall and a greater width adjacent to the bottom wall and with the lower portion having an essentially common thickness throughout at least a majority of its extent, the side walls being located closer together adjacent to the top wall than adjacent to the bottom wall whereby the foot hole is formed of four facing planar surfaces in a trapezoidal configuration;

an upper portion having a strap hole with a transverse axis there through perpendicular to the longitudinal central axis of the foot hole and formed with an essentially horizontal top wall, an essentially horizontal bottom wall, and spaced arcuate side walls therebetween, whereby the strap hole is formed in an oval shaped configuration with a width greater than the width of the top and bottom walls of the lower portion; and an intermediate coupling portion between the lower portion and the upper portion thereby forming a one piece monolithic stirrup molded from an elastomeric material selected from the class of elastomers including polyurethane, polyethylene, and rubber, natural or synthetic or blends thereof, and with the height of the lower portion being about three times the height of the upper portion and with the lower surface of the upper wall of the lower portion being flat and planarly coextensive with the lower surface of the upper portion.

2. A stirrup comprising:

a lower portion having a foot hole with a longitudinal central axis there through and formed with a top wall, a bottom wall, and spaced side walls therebetween, each side wall being trapezoidal in shape and having a shorter width adjacent to the top wall and a greater width adjacent to the bottom wall, the side walls being located closer together adjacent to the top wall than adjacent to the bottom wall whereby the foot hole is formed in a trapezoidal configuration;

an upper portion having a strap hole with a transverse axis there through perpendicular to the longitudinal central axis of the foot hole and formed with a top wall, a bottom wall, and spaced side walls therebetween, whereby the strap hole is formed with a width greater than the width of the top and bottom walls of the lower portion; and an intermediate coupling portion between the lower portion and the upper portion thereby forming a one piece monolithic stirrup.

3. The stirrup as set forth in claim 2 wherein the stirrup is molded from an elastomeric material selected from the class of elastomers including polyurethane, polyethylene, and rubber, natural or synthetic or blends thereof.

4. The stirrup as set forth in claim 2 wherein the height of the lower portion is about three times the height of the upper portion.

5. The stirrup as set forth in claim 2 wherein the lower surface of the upper wall of the lower portion is flat and planarly coextensive with the lower surface of the upper portion.

* * * * *